US005613984A

United States Patent [19]

Nightingale et al.

[11] Patent Number: 5,613,984

[45] Date of Patent: Mar. 25, 1997

[54] PROCESS FOR LAUNDERING PAINT SOILED GARMENTS

[75] Inventors: Robert I. Nightingale, Downsview, Canada; Charles W. Berndt, Highland Park, Ill.

[73] Assignee: Exfoliation Systems, Ltd., Ontario, Canada

[21] Appl. No.: 362,642

[22] Filed: Dec. 23, 1994

[51] Int. Cl.[6] ..... D06B 1/02; D06B 9/00

[52] U.S. Cl. ..... 8/142; 8/137; 134/25.4; 134/26; 134/29; 134/38; 510/281; 510/285

[58] Field of Search ..... 8/142, 137; 252/8.6, 252/8.9, 156, 158, 162, 170, 171, 172, 122, 153; 510/281, 283, 285, 365, 528; 134/25.4, 26, 29, 38

[56] References Cited

U.S. PATENT DOCUMENTS

| | | | |
|---|---|---|---|
| 3,309,166 | 3/1967 | Moncada et al. | 8/142 |
| 3,764,544 | 10/1973 | Haworth | 252/170 |
| 3,772,205 | 11/1973 | Dongas, Sr. | 252/171 |
| 3,872,021 | 3/1975 | McKnight | 252/121 |
| 4,013,575 | 3/1977 | Castrantas et al. | 252/104 |
| 4,266,938 | 5/1981 | Ward | 8/137 |
| 4,295,845 | 10/1981 | Sepulveda et al. | 8/139 |
| 4,612,141 | 9/1986 | Faurote, Jr. et al. . | |
| 4,637,892 | 1/1987 | Merryman | 252/139 |
| 4,673,524 | 6/1987 | Dean . | |
| 5,082,692 | 1/1992 | Cavill | 427/142 |
| 5,413,729 | 5/1995 | Gaul | 252/162 |

FOREIGN PATENT DOCUMENTS

| | | |
|---|---|---|
| 59-157166 | 9/1984 | Japan . |
| 1330442 | 9/1973 | United Kingdom . |
| 2233339 | 1/1991 | United Kingdom . |
| WO94/17143 | 8/1994 | WIPO . |

OTHER PUBLICATIONS

Derwent Astract No. 87–114031, Mar. 1987.

DATABASE WPI, Section Ch, Week 8716, Derwent Publications Ltd., London, GB; Class A35, AN 87–114031, XP002002640; Du Pont De Nemours Co: "Paint remover contg. di:alkyl aliphatic di:carboxylate ester –as main solvent contg. no chlorinated solvent and with low vapour pressure" –10 Mar. 1987.

Kirth–Othmer Encyclopedia of Chemical Technology, Fourth Edition, vol. 8, pp. 129 and 135 (1993) (Month Unknown).

*Primary Examiner*—Alan D. Diamond

*Attorney, Agent, or Firm*—Lowe, Price, LeBlanc & Becker

[57] ABSTRACT

A process for laundering garments soiled with a one component paint, a two component paint, a waterborne paint, a powder coat paint or a mixture thereof comprising the steps of exposing the soiled garment to an acid ester; subsequently washing the garment by exposing the garment to at least one detergent and to at least one alkali to remove paint solids adhered to the garment in the presence of a coating solvent to prevent the redeposition of the paint solids removed from the garment by the detergent and the alkali and, subsequently drying the garment.

15 Claims, No Drawings

PROCESS FOR LAUNDERING PAINT SOILED GARMENTS

FIELD OF THE INVENTION

This invention relates to a process for laundering garments which are soiled by paint, such as overalls worn by workers in automobile paint facilities.

BACKGROUND TO THE INVENTION

In various manufacturing operations, workers are supplied with garments such as overalls or other forms of overclothes. These garments become soiled during the course of work. Typically, these garments require laundering after each wearing. Exemplary of this is car manufacturing plants. The exterior paint layer of a car forms an integral part of the car's anticorrosion systems. To ensure the proper formation of the exterior paint layer, cars are typically painted in strictly controlled environments. Since small particulates can compromise the integrity of the paint, workers in the paint facilities wear overclothes which are supplied by the manufacturer to prevent, or limit, the contamination of the environment. Typically, these garments become soiled with paint and, by the end of each shift, the garments require laundering.

Various processes have been developed to launder such garments. For example, paint soiled garments may be collected and sent to a commercial laundry where they may be washed in a detergent containing bleach or an alkali solution. These garments are then returned to the paint spray facility. One difficulty with such processes is that they do not thoroughly clean the garments. The washed garments will generally still contain residual paint. Such residue reduces the useful life of the garment. Over a course of several washings, this residual paint will continue to build up. Typically, such garments are used and washed only about 30 times before they are discarded.

SUMMARY OF THE INVENTION

In accordance with the invention, there is provided a process for laundering garments soiled with a one component paint, a waterborne paint, a powder coat paint or a mixture thereof comprising the steps of:

(a) exposing the soiled garment to an acid ester;

(b) subsequently washing the garment by exposing the garment to at least one detergent and to at least one alkali to remove paint solids adhered to the garment in the presence of a coating solvent to prevent the redeposition of the paint solids removed from the garment by the detergent and the alkali; and, (c) subsequently drying the garment.

The ester is preferably a basic acid ester, more preferably a di-basic acid ester and, most preferably, an aliphatic di-basic acid ester. The detergent is preferably a nonionic detergent. The solvent is preferably an aromatic solvent, more preferably a light aromatic solvent, and most preferably solvent naphtha. After the drying step, the garment preferably contains a paint repelling amount of said solvent.

The garment is preferably exposed to the ester prior to the paint curing on the garment.

The garment is preferably treated to contain a paint repelling amount of an aromatic solvent prior to the garment being first soiled with paint.

In an alternate embodiment, there is provided a process for laundering garments soiled with a one component paint, a two component paint, a waterborne paint, a powder coat paint or a mixture thereof comprising the steps of:

(a) exposing the soiled garment to an acid ester prior to the paint curing on the garment;

(b) subsequently washing the garment by exposing the garment to at least one detergent and to at least one alkali to remove paint solids adhered to the garment in the presence of a coating solvent to prevent the redeposition of the paint solids removed from the garment by the detergent and the alkali; and, (c) subsequently drying the garment.

DESCRIPTION OF THE PREFERRED EMBODIMENT

The process is for use in laundering garments which are soiled with paints. Various different paints are employed in industry. For example, in the automotive field, several different paints are utilized including one component paints, two component paints, waterborne paints and powder coat paints. One component paints typically have a high level of solids and generally dry (or cure) in about 48 hours at room temperature. Two component paints typically comprise a first component which includes the paint solids and a second component which may generally be described as a fixer. The fixer acts as a catalyst so as to increase the rate of drying. Two component paints generally dry in about 18 to 24 hours at room temperature. Waterborne paints have lower solid levels and generally dry in about 24 hours at room temperature. Similarly, powder coat paints will also cure in about 24 hours at room temperature. Preferably, this process is used on garments which are soiled with a one component paint, a two component paint, a waterborne paint, a powder coat paint or mixtures thereof.

The garments which are soiled with the paint may be made from a variety of materials. For example, the garment may be made from a woven synthetic fabric (such as nylon or polyester) or a woven natural fibre (such as cotton or rayon). The garment may also be made from a non-woven fabric such as TYVEK™ (a spunbonded olefin). Some laminates may also be utilized. Some of the chemicals utilized in this process may have a deleterious effect on laminates. In particular, the chemicals may attack the adhesive which is used to bond the laminate layers together such that the individual layers of the laminate may separate from each other during the laundering process. The adhesive utilized in some laminates, such as TETRATEX™ are not attacked by the chemicals used in the instant application and may be laundered by this process. There are numerous laminates which are available for use by industry. A person skilled in the art will be able to determine which laminates may be utilized according to this process.

The soiled garments are preferably laundered prior to the paint fully drying (curing). If the garments can not be laundered while the paint is still tacky and the paint is a one component paint, a waterborne paint, a powder coat paint or a mixture thereof, then while the laundering process may remove a substantial amount (for example about 60%), the process will not necessarily remove all of the paint soil. If the paint is a two component paint in which the catalyst has fully cured, then the process will not remove the cured paint.

If the laundry facility is located near the plant where the garments are soiled, then the garments may be immediately shipped, for example after the shift during which they are soiled, to the laundry facility for cleaning. In other cases, the laundry facility may be located at some distance from the plant or the laundry facility may not be able to clean the garments shortly after they are soiled (e.g. the laundry facility is closed for the weekend or holidays).

If the garments can not be laundered while the paint is still tacky, then the garments are preferably treated so as to delay the curing of the paint. In such cases, the garments may be sealed in a package (e.g. 1 mil polyethylene) and then shipped to the laundry facility. Garments which are stained with a one component paint, a waterborne paint or a powder coat paint are preferably stored at a temperature below about 100° F. and at a moisture content above about 35%. Paints soiled with a two component paint are preferably stored at a temperature less than about 50° F. (more preferably less than about 40° F.) and at a moisture level above about 40% and more preferably above about 45% moisture.

Once the used garments are placed in a package, excess air is preferably removed from the package and the packages are then sealed and stored under the conditions set out above. Garments treated in this manner may be stored, once packaged, for up to 48 hours, more preferably up to about 24 hours, and most preferably up to about 12 hours prior to laundering. It should be noted, that by the time the garments are packaged, some of the paint on the garments may be up to about 8 hours old.

At the laundry facility, the garments are pretreated with an ester. The garment is then washed, rinsed and dried. The dried garment may then be shipped back to the paint facility.

As stated above, the soiled garments are first pretreated by exposing the garment to an acid ester. Preferably, the ester is a basic acid ester, more preferably, the ester is a di-basic acid ester and most preferably, the di-basic acid ester is an aliphatic di-basic acid ester. The ester may be of the general formula:

$$R^1OOR^2OOR^3$$

wherein $R^1$ and $R^3$ are the same or different and are selected from the group consisting of hydrogen and a lower alkyl group having 1 to 10 carbons; and, wherein $R^2$ is a lower alkyl group having 1 to 10 carbons. Examples of such di-basic acid esters include dimethyl glutarate, dimethyl succinate and dimethyl adipate.

If the garment is only lightly soiled, (for example only a few locations on the garment are soiled with paint), then a solution containing the ester may be sprayed on to the spots which require treatment. Alternately, if the garment is heavily soiled, then the entire garment may be soaked in a solution containing the ester. Preferably, the solution contains from about 20 to about 100 wt. % ester, more preferably from about 45 to about 100 wt. %, and most preferably, from about 85 to about 100 wt. %. The ester acts to stop the paint from setting. Without being limited by theory, it is believed that the ester acts to stop the curing (polymerization) process. In addition, the ester commences to break up the chemical bonds in the paint. This prepares the paint for the washing process during which the paint is removed from the garment.

The ester may be applied at various temperatures to the soiled garment. Due to the volatility of the ester, it is preferred to apply the ester at a temperature from about 60° to about 150° F. More preferably, the ester is applied at room temperature (about 60° to about 72° F.).

Once the garment has been treated by exposure to the ester, the garment proceeds to the washing step. The washing step assists in breaking up additional paint solids which remain on the fabric and taking the paint solids into solution. The garment is preferably washed shortly (e.g. 1 hour) after the pretreatment step before the ester volatilizes. At this time, the fabric is washed in the presence of at least one detergent and at least one alkali compound. The detergent may be any of those known in the art for paint solids. The detergent isolates the solid paint particles and takes these into solution so that the paint solids may be removed. The detergent may be an anionic or a nonionic detergent. Preferably, the detergent is selected from the group consisting of ethoxylates and phosphates.

Generally, in order for detergents to take the solid paint particles into solution, a complimentary solvent must be provided for the detergent. Preferably, the solvent is an organic solvent. More preferably, the solvent is an aromatic solvent. Most preferably, the solvent is a light aromatic solvent such as solvent naphtha.

The alkali may be any of those which is known in the art. The alkali acts to break up the molecular structure of the paint so that it may be solubilized by a detergent. The alkali may be an hydroxide (e.g. sodium hydroxide) or a silicate (e.g. sodium orthosilicate).

The detergent and alkali may be mixed together in any order with the garment and applied to the garment in any manner known in the laundering art. In order to thoroughly expose all portions of the garment to the detergent and the alkali, the garments are preferably immersed in water into which the detergent and the alkali are subsequently added. It will be appreciated that, in order to assist the mixing of the chemicals with the garments, the garments may be agitated during the washing process. Accordingly, the garments may be added to a suitable washing machine to which water is added. The detergent and alkali are then added to the garments as described above.

The concentration of alkali in the wash water is preferably from about 0.5 to about 1.5 g/l, more preferably from about 0.9 to about 1.5 g/l and, most preferably from about 1 to about 1.5 g/l. The concentration of the detergent may range from about 1 to about 3 g/l, more preferably from about 1.5 to about 3 g/l and, most preferably from about 2 to about 3 g/l. The solvent for the detergent is present in a sufficient amount to solubilize the paint solids. The concentration of the solvent may range from about 0.5 to about 2 vol %, more preferably from about 1 to about 2 vol % and, most preferably from about 1.5 to about 2 vol %.

The alkali and detergent may be repeatedly applied to the garment so that the garment is washed a plurality of times. The number of washes to which the garment is subjected will vary depending upon the degree of the curing of the paint, the degree of soiling of the paint and the type of paint. Preferably, the garment is washed with the alkali and the detergent at least twice and, more preferably, three times during the wash cycle.

In order to increase the effectiveness of the detergent, the washing step may occur at an elevated temperature (e.g. above about 90° F. but sufficiently low so as not to damage the fabric). Preferably, the washing step may occur at a temperature from about 90° to about 160° F., more preferably from about 130 to about 160° F. and, most preferably about 145° F. The higher temperature ranges are preferably utilized as the higher temperatures aid the solubility of the detergent and alkali. However, the use of higher temperatures in the presence of higher alkali concentrations is deleterious to some fabrics, such as polyester, and accordingly lower temperatures are preferably used for these fabrics. In addition, if the garments are soiled with a two component paint, it is preferred that at least the initial washing steps, if not all washing steps occur at the lower end of the range (about 90° to about 145° F.). If at least one of the washing steps occurs at the higher end of the temperature range, then the temperature of the garments is preferably gradually reduced so as to avoid temperature shock to which some fabrics such as polyester are prone.

Subsequent to the washing step, the garments are rinsed with water to remove all, or substantially all, of the residual chemicals. To this end, the garments may be repeatedly exposed to water. For example, the garments may be run through a plurality of rinse cycles in a washing machine whereby in each rinse cycle the garments are soaked in water and the water is then removed by draining the water and subjecting the garments to centrifugal action (such as in a spin dryer of a washing machine) at high r.p.m.

After the rinse step, the garments are dried. The garments may be dried by a combination of centrifugal action (such as by a spin dry cycle of a washing machine) and by exposing the garments to an elevated temperature below the degradation temperature of the fabric (such as in a dryer). The temperature at which the clothes are dried is based upon the fabric which is utilized. For example, if the garments comprise polyester, then the clothes are preferably dried at a temperature up to about 145° F. Above this temperature, the polyester fibre will degrade.

The garments are preferably exposed to an aromatic solvent such that at least a portion of the aromatic solvent remains in the garment when the garment is next worn. It has surprisingly been found that leaving residual amounts of an aromatic solvent on the garment increases the soil repellency of the fabric. Without being limited by theory, it is believed that the presence of small amounts of an aromatic solvent in the interstices of the fabric itself acts as an anti-redeposition agent which aids in reducing the adhesion between the paint and the fabric of the garment. Preferably, the residual amount of aromatic solvent in the dried garment is from about 0.1 to about 1 vol %, more preferably from about 0.3 to about 1 vol % and, most preferably from about 0.5 to about 1 vol %. If greater than about 1 vol % is used, then the solvent may cause skin irritation for the individual who wears the garment.

The aromatic solvent may be added during the washing process and, preferably, the organic solvent is the same as that which is added with the detergent in the washing step. Accordingly, the garments are preferably not completely dried. Preferably, the garments are dried so as to contain from about 1 to about 5 wt. % moisture, more preferably from about 3 to about 5 wt. % and, most preferably, about 5% moisture.

Depending upon the chemicals which are utilized, the pH of the garments subsequent to the rinse step may vary broadly, e.g. from about 4 to about 12. Preferably, the pH of the garments is adjusted so as to increase the longevity of the garments and decrease, or eliminate, any skin irritation which may be caused to the worker. Preferably, the pH is neutralized to a skin normal pH (e.g. from about 5.5 to about 6.5). If the pH of the garment after the rinsing cycle is acidic, then the pH is neutralized by the addition of a basic compound such as sodium hydroxide. Alternately, if the pH of the garments after the washing cycle are basic, then the garments may be neutralized by an acidic compound such as hydrofluosilicic acid or phosphoric acid.

After the drying step, the garments are ready to be used. If the garments are to be used shortly after the washing step, then the garments may be sent to the plant where they are to be used. However, over time, the aromatic solvent which is preferably applied to the garments will evaporate from the clothing reducing the degree of soil repellency of the garment. The rate of deterioration of the soil repellency will vary depending upon the volatility of the aromatic solvent which is used and the temperature at which the garments are stored. Generally, the garments may be stored for up to about one week if a light aromatic solvent is utilized before the soil repellency deteriorates to an undesirable level. If the garments are not to be used immediately, the garments are preferably sealed (such as by packaging them in 1 mil polyethylene bags from which the excess air has been removed).

In an alternate embodiment, the garments are preferably treated by exposing them to an aromatic solvent before they are first soiled. As discussed above with respect to the washing step, the aromatic solvent adds a degree of soil repellency to the fabric thereby reducing the adherence of paint to the garment. The aromatic solvent is preferably a light aromatic solvent such as solvent naphtha. The garment is exposed to the aromatic solvent so that a portion of the aromatic solvent is retained in the interstices of the fabric. Preferably, the fabric contains from about 0.1 to about 1 vol %, more preferably from about 0.3 to about 1 vol % and, most preferably from about 0.5 to about 1 vol % of the aromatic solvent. The aromatic solvent may be applied to the fabric by subjecting the garment to a preliminary washing step in which an aromatic solvent is added to the garment while in a washing machine, preferably with agitation.

As discussed above, the aromatic solvent is volatile. Accordingly, depending upon the amount of time before the garment is soiled, it is preferred to seal the garment in, e.g. a 1 mil polyethylene bag, so as to retain the aromatic solvent in the fabric.

In many cases, paint facilities are operated as cleanrooms so as to reduce the contaminants which are included in the coat of paint which is applied. In particular, paint facilities have varying cleanroom standards which must be met by any article, including garments, which are brought into the paint facility. For example, automobile companies typically require that garments utilized in a paint facility have less than about 1% of particles less than 10μ in size removed therefrom. Accordingly, if the garments laundered according to this invention are to be used in the cleanroom, then the garments are preferably washed in a cleanroom environment and sealed subsequent to the washing/drying operation. In addition, in order to control the contamination of the garments, the garments, subsequent to soiling, are preferably packaged in a sealed container.

New garments typically also contain various soils from the manufacturing process as well as loose fibre and threads. In such a case, the preliminary washing step for new garments which are to be utilized in a cleanroom environment preferably also includes subjecting the garments to the washing/drying steps described above. These steps aid in removing soils from the manufacturing process and residual fibres from the garments so that the garments meet the requisite cleanroom standard. These and other advantages of the instant invention will be more fully and particularly understood in connection with the following description of the Examples.

EXAMPLE 1-COMPARATIVE EXAMPLE

Forty coveralls, each of which was manufactured from 100% polyester, were soiled with a PPG Canada Inc. one component high-solids automotive paint. To this end, the coveralls were worn by workers at a paint spray facility using this paint for a standard eight hour shift. After the shift, the coveralls (about 20% of each of which were covered with paint) were removed by the workers and immediately shipped for laundering. The laundering of the garments commenced within about 3 hours of the end of the shift.

The garments were placed in a Wascomat FL184™ commercial washing machine having liquid chemical feed by micro processor controlled peristaltic pumps. The coveralls were subjected to three washing cycles. In the first cycle, fourteen gallons of water at 86° F., 16 oz. of solution A and 4 oz. of solid mixture B were added to the washing machine.

Solution A:

solvent naphtha—60 wt. % nonylphenol ethoxolate—40 wt. %

Solid Mixture B:

sodium tripolyphosphate—16.5 wt. %

NaOH—10 wt. %

$CaCl_2$—3.5 wt. % soda ash—21 wt. % sodium orthosilicate—36.5 wt % nonylphenol—12.5 wt. %

The coveralls were agitated in this mixture for 10 minutes and the wash water was then drained from the washing machine. In the second cycle, 14 gallons of water at 160° F. with 8 oz. of solution A and 4 oz. of solid mixture B were added to the washing machine. The coveralls were washed in the washing machine with agitation for 5 minutes at the end of which time the water was drained. In the third cycle, 14 gallons of water at 160° F. and 8 oz. of the solid mixture B were added to the washing machine. The coveralls were washed in the washing machine with agitation for 5 minutes at the end of which time the water was drained from the washing machine.

The coveralls were then rinsed in four cycles. In the first cycle, 16 gallons of water at 160° F. were added to the washing machine. The coveralls were agitated in the washing machine for 2 minutes at the end of which time the water was drained from the washing machine. This cycle was repeated three times. Each additional rinse cycle used water at 140° F., 120° F. and 100° F. respectively.

The coveralls were then subjected to a pH adjusting rinse. According to this step, 14 gallons of water at 86° F. and 2 oz of a solution comprising 20 wt. % of hydrofluosilicic acid were added to the washing machine. The coveralls were agitated in this mixture for 2 minutes at the end of which time the rinse water was drained from the washing machine. The coveralls had a pH from about 5.5 to about 6.5.

The coveralls were dried by placing them in a steam injected Heubsch commercial drier for 22 minutes. At the end of this time, the coveralls, which had a moisture content of about 10% (as was determined by a hygrometer) were removed from the drier and examined. Only about 80% of the hard paint which had been present the coveralls when they were received from the paint facility had been removed. In addition, red and black pigments, which were present in the paint, were still visible on about 15% of each coverall (i.e. only about 50% removal). The hard paint which was left on the garment would limit the number of times which the garments could be worn. In addition, the hard paint could flake off during use and contaminate a car which is being painted. Accordingly, these garments could be worn for only about 75 times before they would have to be discarded.

EXAMPLE 2

The same experiment was repeated with the following variations. Ten 100% polyester overalls were utilized in the same paint facility for an 8 hour shift. When the coveralls were returned for laundering, the coveralls were first placed in a polyethylene wash basin and immersed in a solution of di-basic esters (66 wt. % dimethyl glutarate, 17 wt. % dimethyl adipate and 16.5 wt. % dimethyl succinate) for 24 hours. The coveralls were then subjected to the same washing and drying steps as set out above.

Virtually all (about 99%) of the hard paint was removed from the 10 coveralls. In addition, most of the pigment (about 75%) was also removed from the 10 coveralls. In particular, the red and black pigments which were present in the paint were only slightly visible in the coveralls. Accordingly, this garment could be worn, on average, about 200–300 times.

EXAMPLE 3

Two 100% polyester coveralls which had not been previously soiled by paint were washed according to the process set out in Example 1. The coveralls, once dried, were each placed in a one mil. plastic bags. The excess air was evacuated from the bags and the bags were sealed.

The sealed bags were taken to the same automotive paint facility referred to in Example 1. In order to heavily soil the coveralls, the coveralls were pressed against a paint soiled paint booth wall. Above about 50% of each garment was covered with the one component paint. The garments were returned for laundering.

The coveralls were placed in a stainless steel soaking tank and immersed in one gallon of the di-basic esther solution referred to in Example 2 for 10 minutes with agitation. The coveralls were then removed from the di-basic esther solution and washed according to the process of Example 1.

Despite the fact that the garments had been heavily soiled with paint, virtually all (about 95%) of the hard paint and pigment were removed from the two coveralls.

EXAMPLE 4

One clean overall of 100% polyester, which had not previously been soiled with paint, was washed according to the process set out in claim 1, dried and sealed in a one mil. plastic bag from the which the excess air had been removed. The clean garment was taken to an automotive paint spray facility which applies a two stage (i.e. a coloured base coat as well as clear top coat) two component low-solids automotive paint. The paint was manufactured by the Red Spot Paint and Varnish Co. The coverall was worn by a paint booth operator for an eight hour shift. The soiled garment was then placed in a one mil. plastic bag and placed in a cold polyethylene container (at a temperature of about 40° F.) and transported back for laundering.

The soiled coverall was placed in a stainless steel soaking tank in one gallon of the di-basic acid esther solution of Example 2 for 24 hours. At the end of the 24 hours, the coverall was placed in the same washing machine referred to in Example 1 and rinsed for 2 minutes in 16 gallons of water at 86° F.

The coverall was then subjected to three wash cycles. In the first wash cycle, 14 gallons of water at 86° F. were added to the washing machine with 16 oz. of solution A and 4 oz. solid mixture B. The coverall was washed for 12 minutes with agitation at the end of which time the water was drained from the washing machine. The second washing cycle utilized 14 gallons of water at 86° F., 8 oz. of solution A and 4 oz of solid mixture B. The coverall was washed with agitation for 6 minutes at the end of which time the water was drained from the washing machine. The third washing cycle utilized 14 gallons of water at 140° F. with 8 oz. of solid mixture B. The coverall was washed for 10 minutes with agitation at the end of which time the water was drained from the washing machine.

The coverall was then subjected to two rinse cycles, each of which used 16 gallons of water and agitation for 2 minutes. The rinse water for the first cycle was at 125° F. and the water temperature for the second rinse cycle 105° F.

The coverall was then subjected to the same pH adjusting rinse as was used in Example 1 and dried according to the same process as used in Example 1.

Approximately 33% of the coverall had been covered with paint. As a result of the laundering operation, most (about 90%) of the hard paint which was on the garment was removed. In addition, (about 90%) of the pigment was also removed from the coverall.

EXAMPLE 5

Three clean coveralls made of 100% polyester, which had not been previously soiled with paint, were prewashed according to the process of Example 1, dried and individual sealed in one mil. plastic bags from which the excess air had been evacuated. The sealed garments were then taken to an automotive paint facility where they were heavily soiled with BASF™ waterborne automotive paint (approximately 50% coverage) by removing the garments from the plastic bags and pressing the garments against the wall of the paint booth. The soiled garments were then each placed in a one mil. plastic bag, placed in a polyethylene container at about 45° F. and transported back for laundering.

The soiled garments were removed from the plastic bag and immersed in two gallons of the di-basic esther solution of Example 2 for 24 hours. At the end of this period, the soaked coveralls were placed in the same washing machine which was used in Example 1 and rinsed for two minutes in 16 gallons of water at 86° F. The garments were then washed and dried according to the procedure of Example 1 except that the wash water for the second wash cycle was at 86° F.

As a result of the washing operation, virtually all of the hard paint and pigment (approximately 95%) were removed from the coveralls.

EXAMPLE 6

One clean coverall made of 100% polyester, which had not been previously soiled with paint, was prewashed according to the process of Example 1, dried and individual sealed in one mil. plastic bags from which the excess air had been evacuated. The sealed garment was then taken to an automotive paint facility where it was soiled with a PPG Canada Inc. powder coat automotive paint. In order to soil the coverall, the coverall was worn by a paint spray operator for a standard eight hour shift at the end of which time approximately 25% of the coverall was covered with paint. The soiled coverall was then placed in a one mil. plastic bag, placed in a polyethylene container at about 45° F. and transported back for laundering.

The soiled garment was removed from the plastic bag and immersed in two gallons of the di-basic esther solution of Example 2 for 24 hours. At the end of this period, the soaked coverall was placed in the same washing machine which was used in Example 1 and washed and dried according to the procedure of Example 1.

Visual observation at the end of the drying cycle determined that all of the hard paint and pigment (approximately 99%), were removed from the coverall. Accordingly, with this level of removal, the garment could be cycled for at least about 200 wearings before it would have to be discarded.

We claim:

1. A process for laundering a garment soiled with a one component paint, a waterborne paint, a powder coat paint or a mixture thereof comprising the steps of:

(a) exposing the soiled garment to a di-basic acid ester;

(b) subsequently washing the garment by exposing the garment to at least one detergent and to at least one alkali to remove paint solids adhered to the garment in the presence of a coating solvent to prevent the redeposition of the paint solids removed from the garment by the detergent and the alkali; and (c) subsequently drying the garment.

2. The process as claimed in claim 1 wherein said ester is an aliphatic di-basic acid ester.

3. The process as claimed in claim 1 wherein said detergent is a nonionic detergent.

4. The process as claimed in claim 3 wherein said solvent is an aromatic solvent.

5. The process as claimed in claim 3 wherein said solvent is a solvent naphtha.

6. The process as claimed in claim 1 wherein the garment is exposed to said ester prior to the paint curing on the garment.

7. The process as claimed in claim 4 wherein, after step (c), the garment contains a paint repelling amount of said solvent.

8. The process as claimed in claim 1 further comprising the step of treating said garment to contain a paint repelling amount of an aromatic solvent prior to the garment being first soiled with paint.

9. A process for laundering a garment soiled with a one component paint, a two component paint, a waterborne paint, a powder coat paint or a mixture thereof comprising the steps of:

(a) exposing the soiled garment to a di-basic acid ester prior to the paint curing on the garment;

(b) subsequently washing the garment by exposing the garment to at least one detergent and to at least one alkali to remove paint solids adhered to the garment in the presence of a coating solvent to prevent the redeposition of the paint solids removed from the garment by the detergent and the alkali; and, (c) subsequently drying the garment.

10. The process as claimed in claim 9 wherein said ester is an aliphatic di-basic acid ester.

11. The process as claimed in claim 9 wherein said detergent is a nonionic detergent.

12. The process as claimed in claim 11 wherein said solvent is an aromatic solvent.

13. The process as claimed in claim 11 wherein said solvent is solvent naphtha.

14. The process as claimed in claim 12 wherein, after step (c), the garment contains a paint repelling amount of said solvent.

15. The process as claimed in claim 9 further comprising the step of treating said garment to contain a paint repelling amount of an aromatic solvent prior to the garment being first soiled with paint.

* * * * *